US006329954B1

(12) United States Patent
Fuchs et al.

(10) Patent No.: US 6,329,954 B1
(45) Date of Patent: Dec. 11, 2001

(54) DUAL-ANTENNA SYSTEM FOR SINGLE-FREQUENCY BAND

(75) Inventors: Andreas Dirk Fuchs, Orion Township; Ronald Andrew Marino, Flushing, both of MI (US)

(73) Assignee: RecepTec L.L.C., Holly, MI (US)

( * ) Notice: Subject to any disclaimer, the term of this patent is extended or adjusted under 35 U.S.C. 154(b) by 0 days.

(21) Appl. No.: 09/549,895

(22) Filed: Apr. 14, 2000

(51) Int. Cl.[7] ..... H01Q 21/00; H01Q 21/26

(52) U.S. Cl. ..... 343/725; 343/797; 343/895

(58) Field of Search ..... 343/895, 726, 343/727, 729, 730, 793, 797, 711, 893, 725

(56) References Cited

U.S. PATENT DOCUMENTS

| | | | | |
|---|---|---|---|---|
| 4,218,685 | * | 8/1980 | Ellis, Jr. | 343/797 |
| 4,466,003 | | 8/1984 | Royce | 343/826 |
| 4,730,195 | * | 3/1988 | Phillips et al. | 343/792 |
| 5,264,862 | | 11/1993 | Kumpfbeck | 343/853 |
| 5,317,327 | | 5/1994 | Piole | 343/725 |
| 5,440,317 | | 8/1995 | Jalloul et al. | 343/791 |
| 5,600,341 | | 2/1997 | Thill et al. | 343/895 |
| 5,923,305 | * | 7/1999 | Sadler et al. | 343/895 |
| 6,160,512 | * | 12/2000 | Desclos et al. | 343/725 |

FOREIGN PATENT DOCUMENTS

| | | | |
|---|---|---|---|
| 19933723 | 1/2000 | (DE) | H01Q/1/36 |
| 0957533 | 11/1999 | (EP) | H01Q/5/00 |
| 2339969 | 2/2000 | (GB) | H01Q/1/36 |
| 4134906 | 5/1992 | (JP) | H01Q/21/30 |
| 6334436 | 12/1994 | (JP) | H01Q/21/26 |
| WO 0059070 | 10/2000 | (WO) | H01Q/11/08 |

* cited by examiner

*Primary Examiner*—Don Wong
*Assistant Examiner*—Hoang Nguyen
(74) *Attorney, Agent, or Firm*—Warner Norcross & Judd LLP

(57) ABSTRACT

A combination satellite and terrestrial antenna system for a single-source application. A first embodiment includes a cross dipole for receiving the circularly polarized satellite signals, and a plurality of monopoles for receiving linearly polarized terrestrial signals. The mono-poles are arranged symmetrically about the cross dipole. Alternative embodiments include a helix antenna for receiving the satellite signals, and one or more linear antennas arranged symmetrically with respect to the helix for the terrestrial signals.

15 Claims, 16 Drawing Sheets

DUAL-ANTENNA SYSTEM FOR SINGLE-FREQUENCY BAND

BACKGROUND OF THE INVENTION

The present invention relates to antenna systems, and more particularly to dual-antenna systems.

A variety of dual-transmitter broadcasting formats are under development. Such formats include simultaneous transmission of signals from both satellite transmitters and terrestrial (or land-based) transmitters. Two of such formats those identified by the trademark SIRIUS RADIO and the trademark XM RADIO. Both formats have published transmission specifications. The satellite transmissions cover the vast majority of the geographic broadcast area. The terrestrial transmissions complement the satellite coverage primarily in urban areas where the satellites may be blocked from a receiver by a building.

New antennas for receiving the dual-transmission signals are required, especially for automotive applications. The antennas (e.g. whips and window grids) typically used in the automotive area adequately receive signals from terrestrial transmitters. However, the radiation patterns of monopoles have their best reception at low elevation angles with nulls at the zenith. Therefore, monopoles are incapable of receiving signals from satellite transmitters.

SUMMARY OF THE INVENTION

The aforementioned problems are overcome in the present invention wherein a dual-antenna system, appropriate for automotive applications, is capable of receiving both satellite transmission signals and terrestrial transmission signals. The system includes a first antenna for receiving satellite transmissions and a second antenna for receiving terrestrial transmissions. The terrestrial antenna is one or more antenna elements arranged either concentrically with, or in a symmetrical configuration with respect to, the satellite antenna.

In a preferred embodiment, the satellite antenna is a cross dipole, and the terrestrial antenna is a plurality of monopoles arranged symmetrically about the cross dipole. In an alternative embodiment, the satellite antenna is a quadrifilar helix, and the terrestrial antenna is a monopole or sleeve dipole positioned concentrically within the helix. In another alternative embodiment, the system includes a helix and a plurality of monopoles arranged symmetrically about the helix.

In the disclosed embodiment, the satellite elements are packaged and housed within a relatively low profile, aesthetically pleasing housing for mounting on a vehicle body panel, such as the roof.

The present invention is capable of receiving both satellite transmissions and terrestrial transmissions. The antenna system can be tuned to meet the SIRIUS RADIO format or the XM RADIO format, and can be scaled to other frequencies. The antenna therefore provides operability heretofore unavailable in an antenna system, particularly in the automotive field.

These and other objects, advantages, and features of the invention will be more readily understood and appreciated by reference to the detailed description of the preferred embodiment and the drawings.

DETAILED DESCRIPTION OF THE PREFERRED EMBODIMENTS

I. Dual-Transmitter Service Applications

Figure 1:
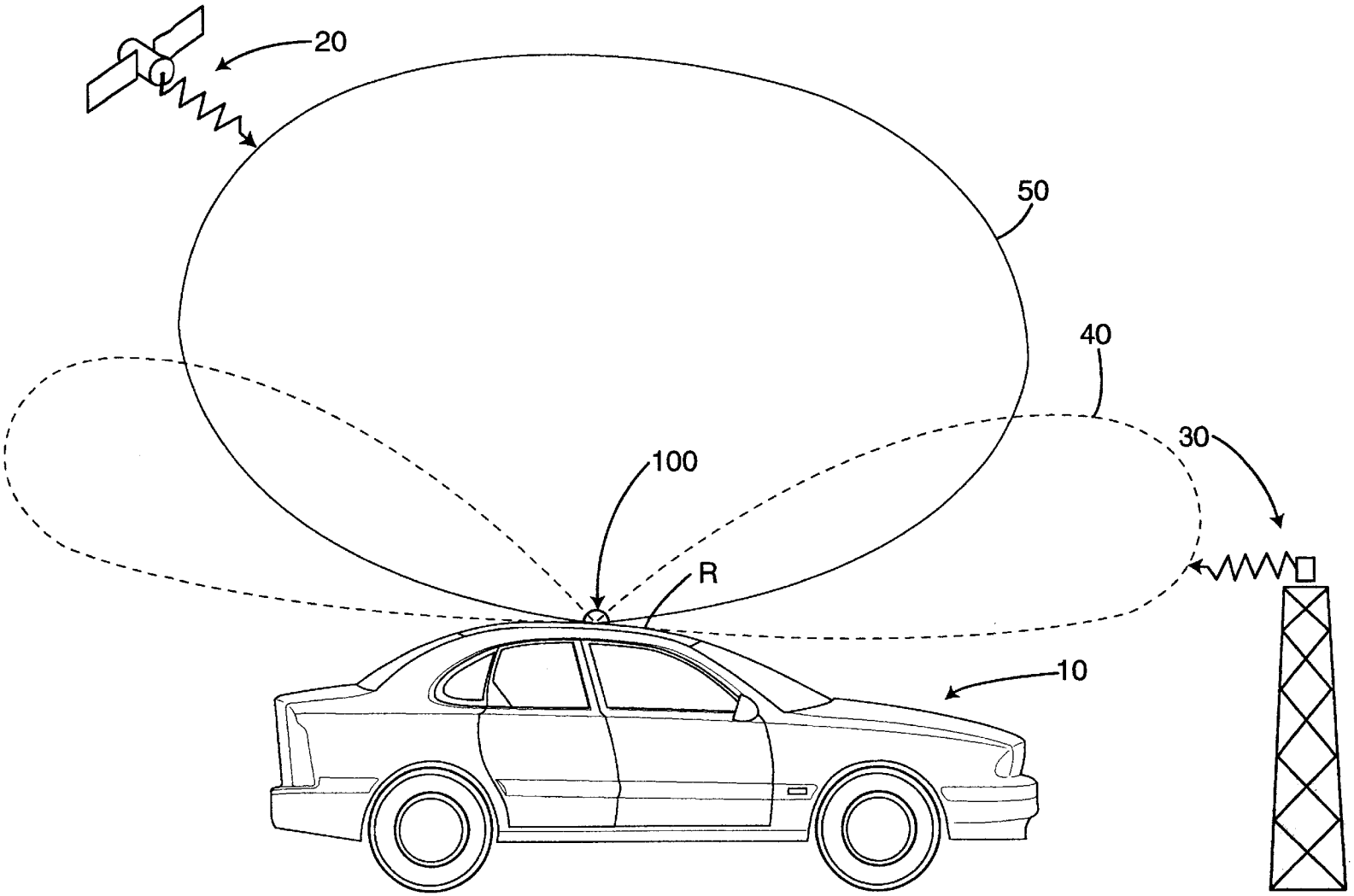
FIG. 1 shows preferred embodiment of the antenna system of the present invention mounted on an automotive vehicle within a dual-transmitter single-service broadcast area.

FIG. 1 illustrates an automobile 10 within a dual-transmission single-service environment. As noted in the Background of the Invention, such broadcasting formats are currently under development. Two known formats are those being developed under the trademark SIRIUS RADIO and the trademark XM RADIO. In such a format, the content is simultaneously broadcast from both satellite transmitters 20 and terrestrial (or land-based) transmitters 30. Both types of transmitters operate in the same frequency band. In the case of SIRIUS RADIO, the band is at approximately 2.32 gigahertz (GHz). In the case of XM RADIO, the frequency band is at approximately 2.35 GHz.

Both the SIRIUS RADIO and XM RADIO formats have published specification identifying satellite reception coverage requirements and terrestrial reception coverage requirements. The terrestrial coverage area 40 and the satellite coverage area 50 illustrated in FIG. 1 are generic illustrations of the basic thrust of these specifications. The two specifications are not identical, but they have the commonality of defining (1) an angle and strength of satellite coverage and (2) an angle and strength of terrestrial coverage. The radiation patterns illustrated in the drawings for this application include the SIRIUS RADIO specifications, but the invention is not limited to the SIRIUS RADIO format. The invention is readily adaptable to other formats.

A conventional automotive antenna, such as a whip or a window grid, is perfectly capable of receiving transmissions from the terrestrial transmitter 30. However, the conventional antennas are not suited to receiving transmissions from the satellite transmitter 20. Accordingly, the antenna system of the present invention has been developed to enable a receiver (not illustrated in FIG. 1) to receive signals from both the satellite transmitter 20 and the terrestrial transmitter 30.

The antenna system 100 of the present invention preferably is mounted on the roof R of the automobile 10. The roof acts as a ground plane for the antenna system 100. Preferably, the antenna system 100 is mounted in the center of the roof to optimize performance. Alternatively, the antenna system 100 can be mounted at other locations on the roof or even other body panels. The position for the antenna system 110 ultimately selected by a car manufacturer will be based on a balance of aesthetics, performance, and receiver requirements.

II. Preferred Embodiment of the Antenna System

Figure 4:
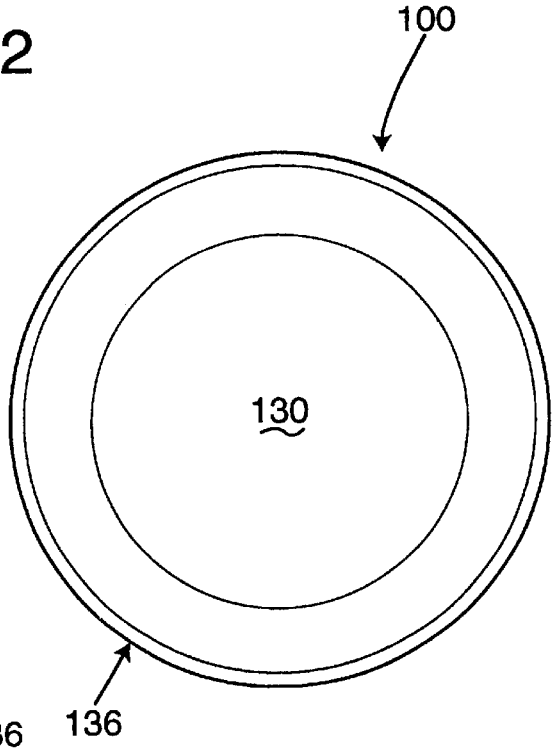
FIG. 4 is a top plan view of the antenna system.
Figure 5:
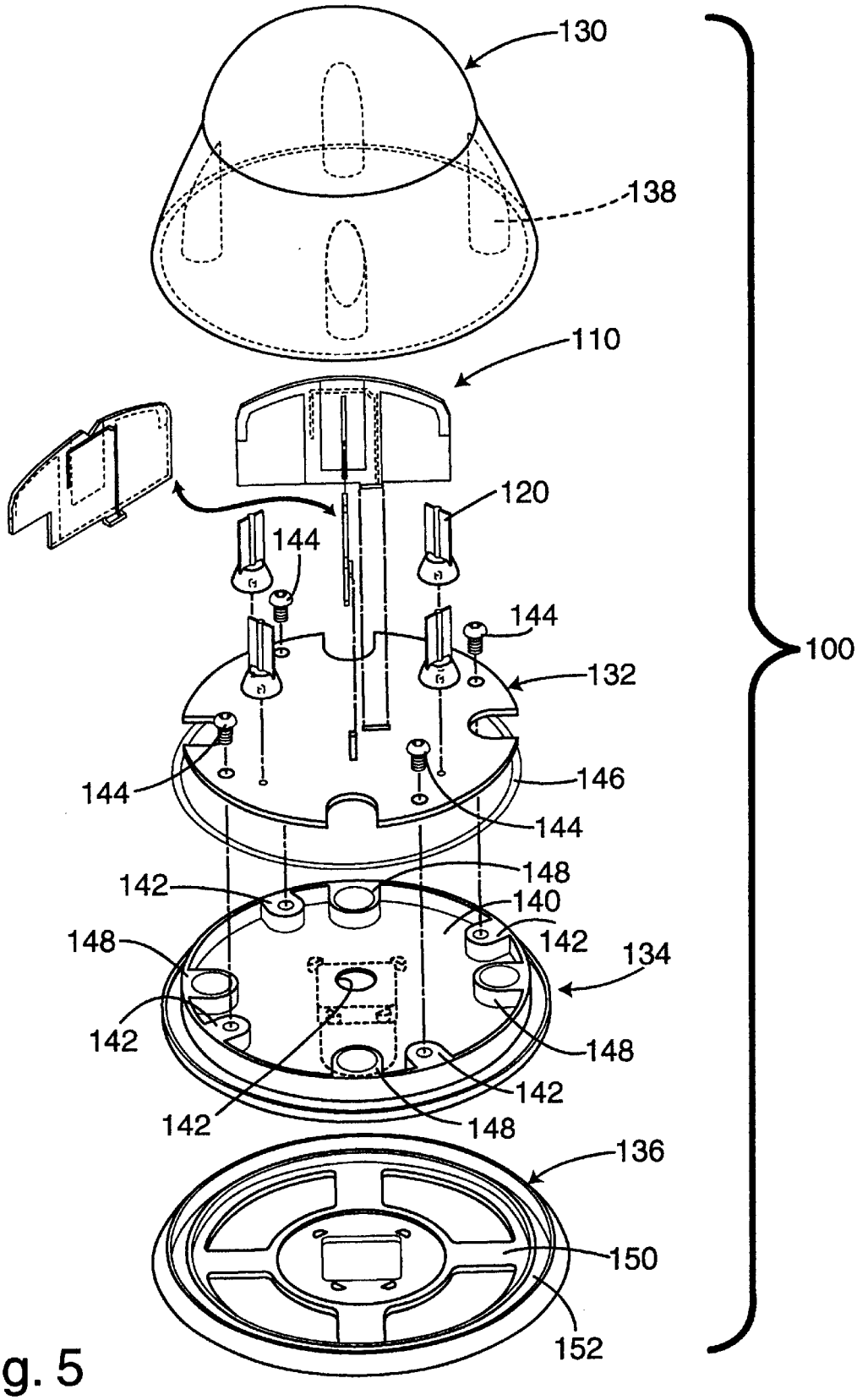
FIG. 5 is a perspective exploded view of the antenna system.
Figure 6:
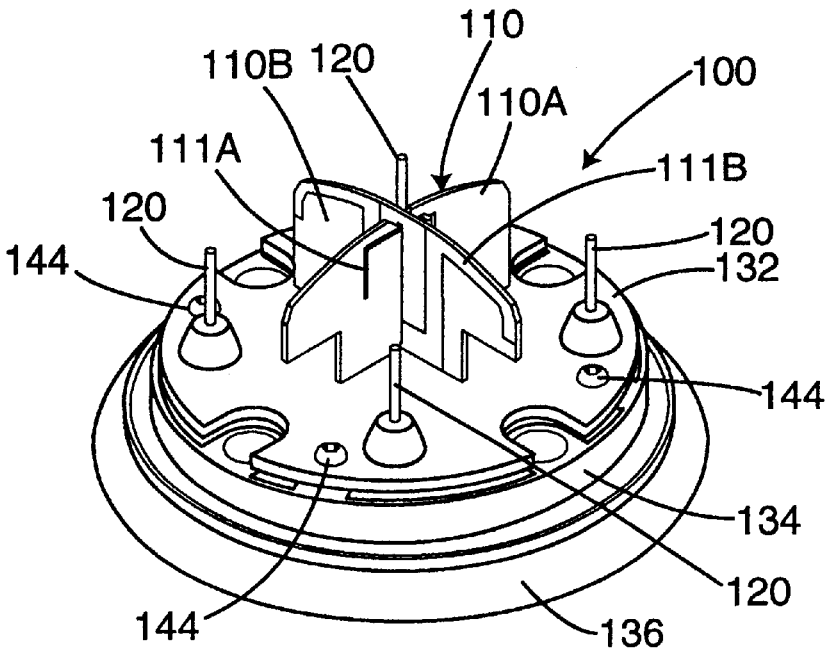
FIG. 6 is a top perspective view of the antenna system with the radome removed.

The preferred embodiment of the antenna system 100 is illustrated in FIGS. 2–9, and perhaps best illustrated in FIG. 5. As seen in FIG. 6, the antenna system 100 includes a bent cross dipole antenna 110 and four monopole antennas 120. The bent cross dipole antenna 110 is adapted to receive circularly polarized signals from the satellite transmitters 20, and the monopole antenna elements 120 are adapted to receive signals from the terrestrial transmitters 30. Accordingly, the cross dipole antenna 110 is referred to as the satellite antenna, and the monopole elements 120 together are referred to as the terrestrial antenna.

Turning to FIG. 5 and identifying the elements from top to bottom, the antenna system 100 includes a dome 130, the cross dipole antenna 110, the monopole antenna elements 120, a printed circuit board 132, a chassis 134, and a gasket 136.

The dome 130 (or radome) is a single piece that is injection molded of an appropriate plastic, such as ASA. The radome provides physical protection to the antenna elements and circuit board within the antenna system. The radome includes four integral lugs 138 for receiving screws (not shown) to intersecure the components of the antenna system 110. Alternatively, the radome may be secured in position with adhesive—either alone or in combination with screws or other fastening means.

The printed circuit board 132 provides a physical support for both the cross dipole 110 and the monopoles 120. The board 132 also carries devices electrically connected to the antenna elements and providing appropriate amplification of the signals received by the elements. The board 132 is otherwise generally well known to those skilled in the art.

The chassis 134 is a single piece of metal such as aluminum. The chassis 134 includes a solid floor 140 defining a central hole 142 through which the antenna leads (not shown in FIG. 5) pass. The chassis 134 also includes four integral lugs 42 which receive the screws 144 to secure the circuit board 132 to the chassis. The chassis 134 further includes four additional lugs 148 for receiving screws (not illustrated) that extend into the lugs 138 in the dome 130. An O-ring 146 is included to provide a weather-tight seal between the dome 130 and the chassis 134.

The gasket 136 is molded of a resiliently deformable material such as thermoplastic rubber. The gasket includes a first recessed area 150 into which the chassis 134 fits and a second recessed area or groove 152 into which the dome 130 fits. When all of the components are intersecured and assembled as shown, the antenna system is weather-tight and provides a weather-tight seal against the automobile 10 when the system is mounted on a vehicle body component.

Figure 7:
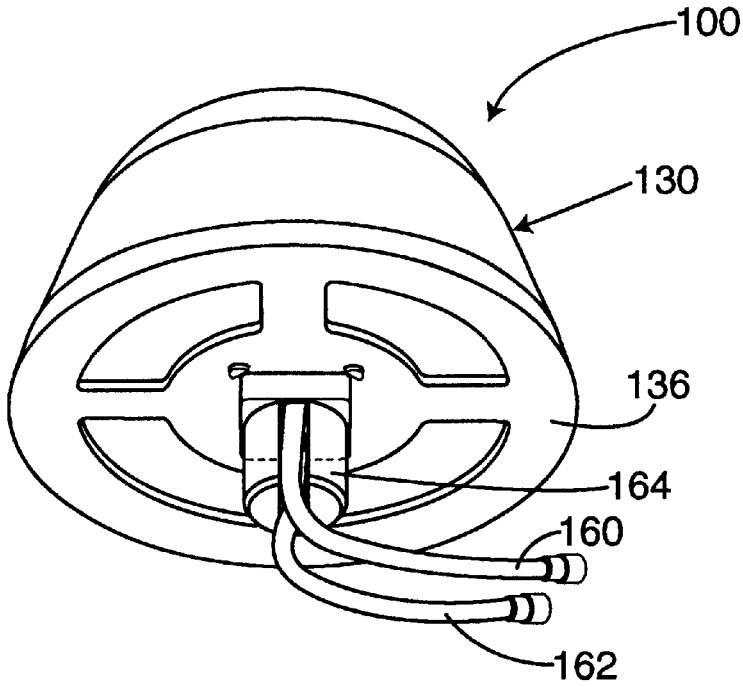
FIG. 7 is a bottom perspective view of the antenna system.

Turning to FIG. 7, a pair of coaxial antenna leads 160 and 162 pass out of the antenna system 100 through the hole 142 (see FIG. 4). A threaded lug 164 is secured within the hole 142 for attaching the antenna system 100 to the vehicle 10 and for protection of the antenna leads 160 and 162.

Figure 2:
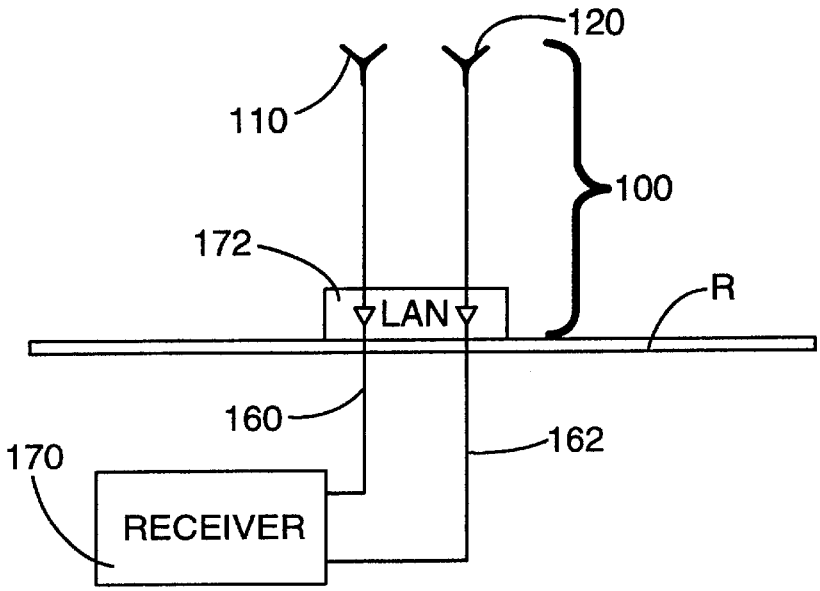
FIG. 2 is a schematic diagram of the antenna system.
Figure 3:
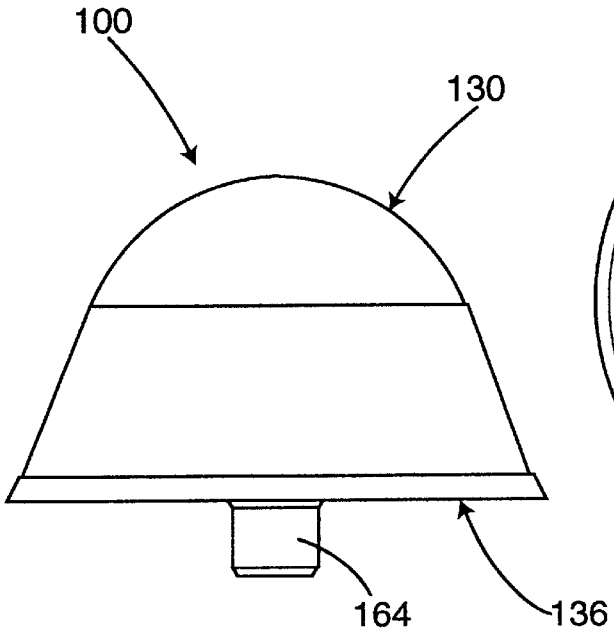
FIG. 3 is a side elevation view of the antenna system.

FIG. 2 schematically illustrates the antenna system 100 mounted on the roof R and connected to a receiver 170. Both the satellite antenna 110 and the terrestrial antenna 120 are connected to a low-noise amplifier (LNA) 172 mounted on the circuit board 132 (see also FIG. 5). The antenna system 100 is mounted on the vehicle roof R which serves as a ground plane for the antenna. The coaxial antenna leads 160 and 162 extend through the vehicle roof R and are connected directly, or through other wiring, to the receiver 170. Appropriate receivers are known to those skilled in the art and are not described here in detail. The receiver 170 includes circuitry for determining which antenna signal is used. The receiver can be mounted at a variety of locations within the vehicle such as behind the dash, in the trunk, or under a seat.

Figure 8:
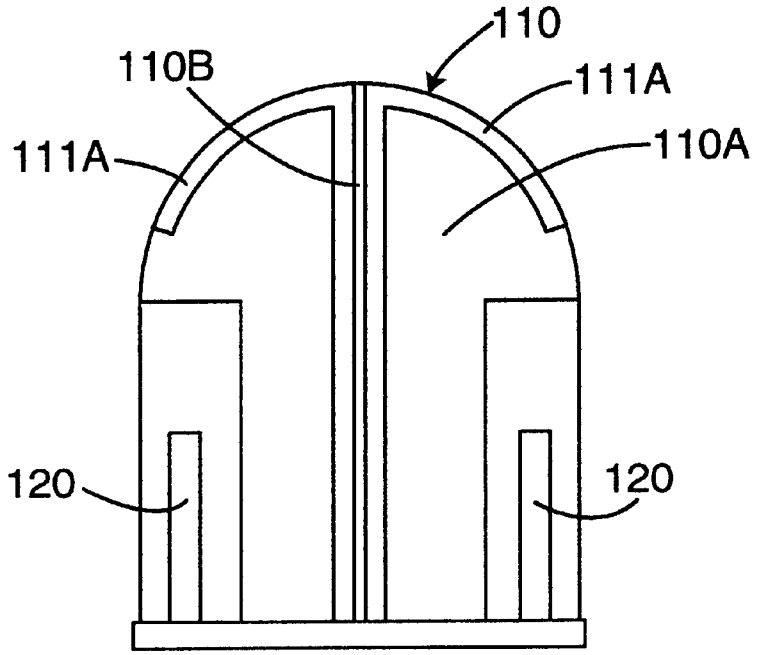
FIG. 8 is a side schematic view of the antenna elements.
Figure 9:
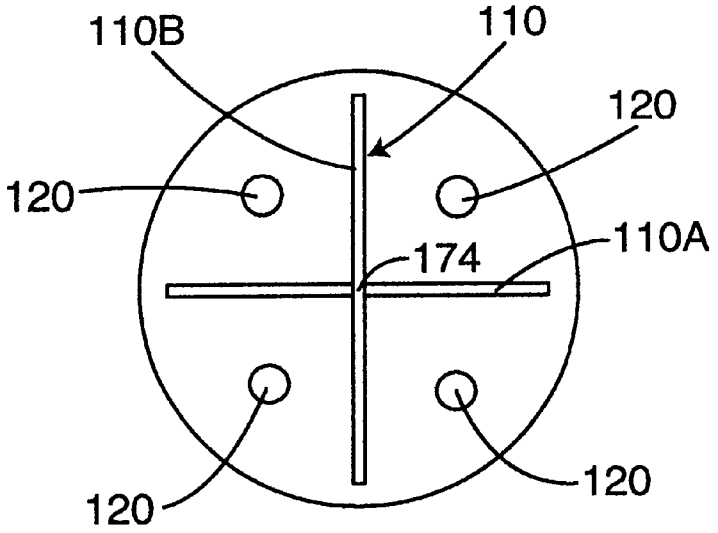
FIG. 9 is a top schematic view of the antenna elements.

FIGS. 8 and 9 illustrate the antenna elements 110 and 120 schematically. The antenna element 110 is a bent, cross dipole antenna of the type generally known to those skilled in the antenna art. The antenna includes a pair of relatively stiff substrates 110*a* and 110*b* that physically interlock. The antenna elements 111*a* and 111*b* are printed, or otherwise formed, on the substrates 110*a* and 110*b* respectively, again using techniques known to those skilled in the art. The cross dipole antenna is particularly well suited to receive the circularly polarized transmissions used in satellite transmissions.

The antenna system 100 includes four monopole elements 120 that together comprise the terrestrial antenna. As perhaps best illustrated in FIGS. 8–9, the monopole elements 120 are arranged in a symmetrical configuration with respect to the cross dipole 110. In the preferred embodiment of four monopoles, one monopole is positioned within each quadrant of the cross dipole. Alternatively, the monopoles 120 could be in the same plane as the cross dipole 110, for example by positioning each monopole 120 on one of the substrates 110*a* or 110*b*. Other numbers and configurations of monopoles will be apparent to those skilled in the art in view of this specification. Also, the monopoles may be a combination of active and parasitic elements arranged in a substantially symmetric pattern. Each monopole is approximately 0.125 lambda to 0.25 lambda in length.

Figure 10:
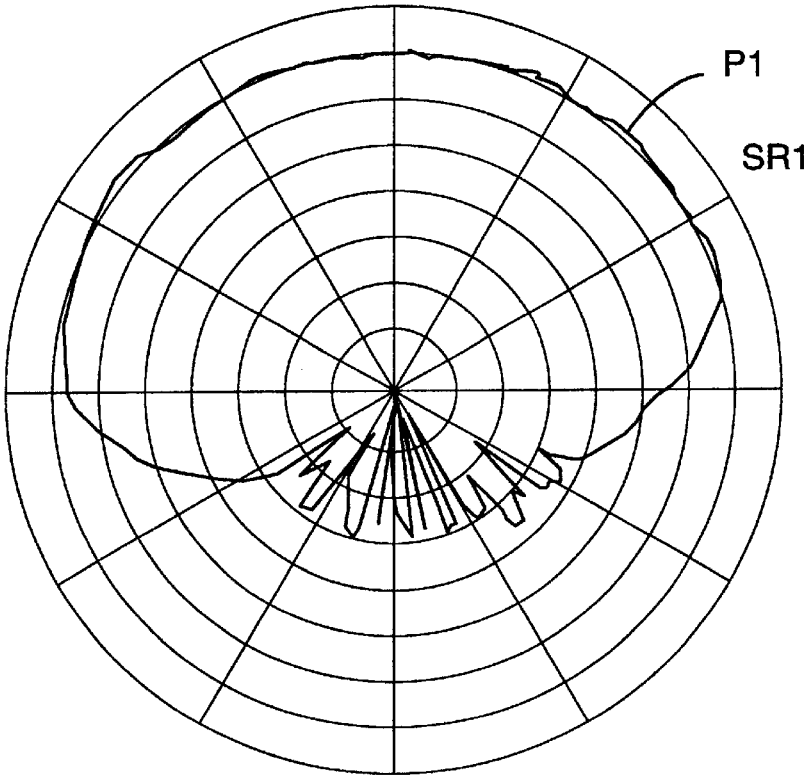
FIG. 10 is an elevation radiation pattern for the satellite antenna in the antenna system.

As will be appreciated from the radiation patterns illustrated in FIGS. 10 et. seq., the symmetrical configuration of the monopoles 120 improves both the performance of the satellite antenna 110 and the terrestrial antenna 120. The monopoles 120 are spaced equal angles from one another about the cross dipole 110, and the monopoles also are spaced equal distances from one another. The number and position of the monopoles 120 and their height can be "tuned" to compliment both the satellite and terrestrial antennas. As used in this application, symmetric and symmetrical are intended to have their broadest meanings wherein one-half of the pattern is a reflection of the other half of the pattern about a point, a line, or a plane. The four monopoles are connected to a corporate feed using any such technique known in the art.

The two antennas are concentric. Specifically, the physical center of the cross dipole antenna 110 and the imaginary physical center of the coupled monopoles 120 are the same—namely at the intersection 174 of the substrates 110*a* and 110*b*.

Figure 11:
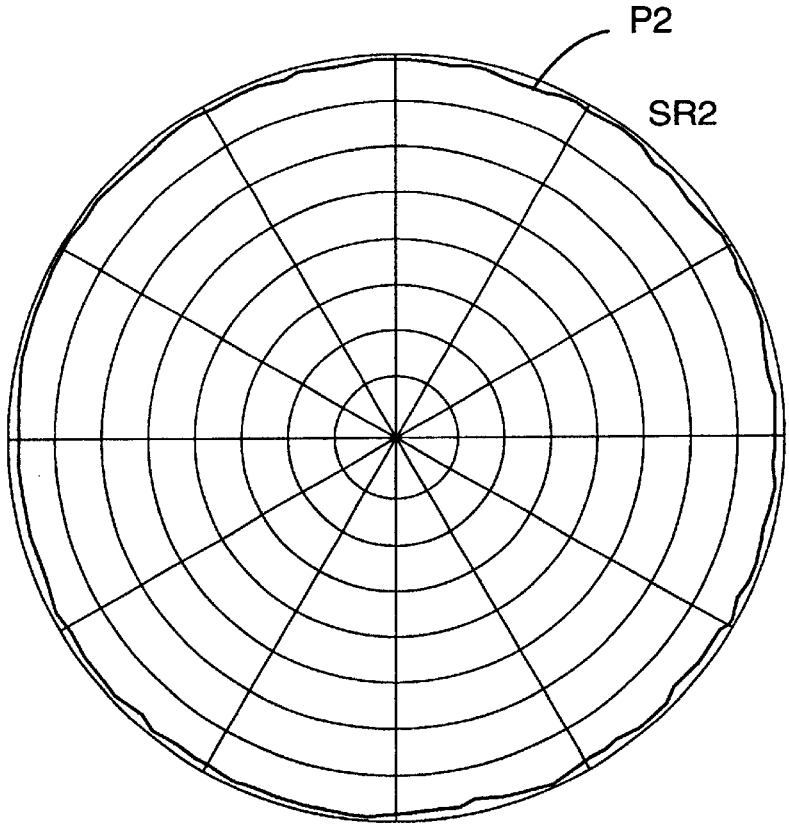
FIG. 11 is an azimuth radiation pattern for the satellite antenna.

FIG. 10 is an elevation radiation pattern for the satellite antenna 110 within the antenna assembly 100; and FIG. 11 is the azimuth radiation pattern at elevation 25 degrees for the same antenna.

Figure 12:
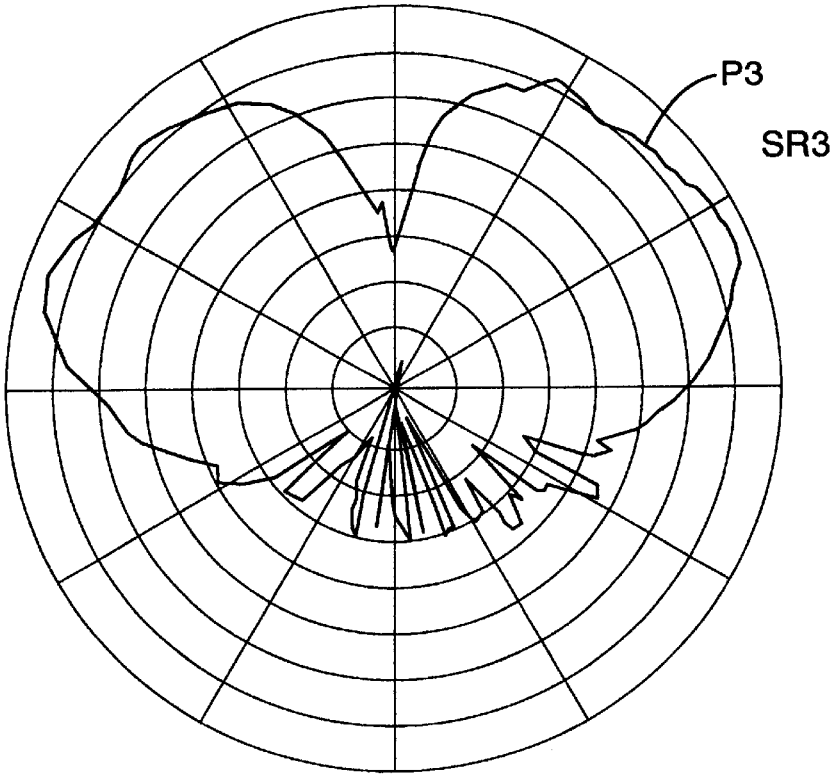
FIG. 12 is an elevation radiation pattern for the terrestrial antenna in the antenna system.
Figure 13:
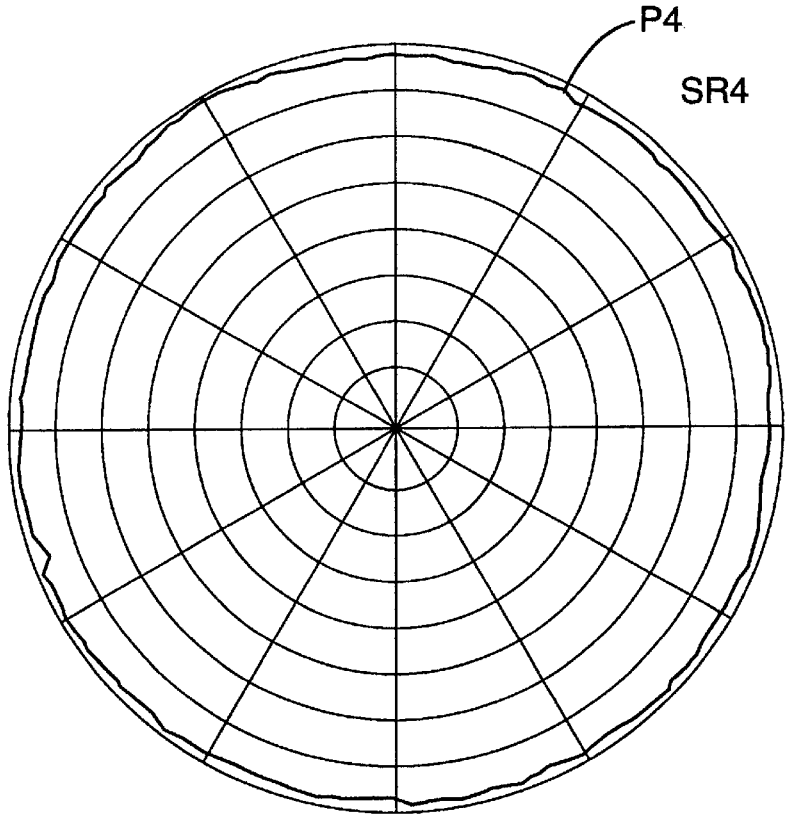
FIG. 13 is an azimuth radiation pattern for the terrestrial antenna.

FIG. 12 is an elevation radiation pattern for the terrestrial antenna 120 within the antenna system 100, and FIG. 13 is an azimuth radiation pattern at elevation 10 degrees for the same antenna.

As illustrated in the azimuth radiation patterns of FIGS. 11 and 13, the azimuth coverage of both the satellite antenna and the terrestrial antenna is symmetric and uniform. The symmetrical positioning of the monopoles 120 with respect to the cross dipole 110 improves the radiation pattern of the satellite antenna 110.

Figure 14:
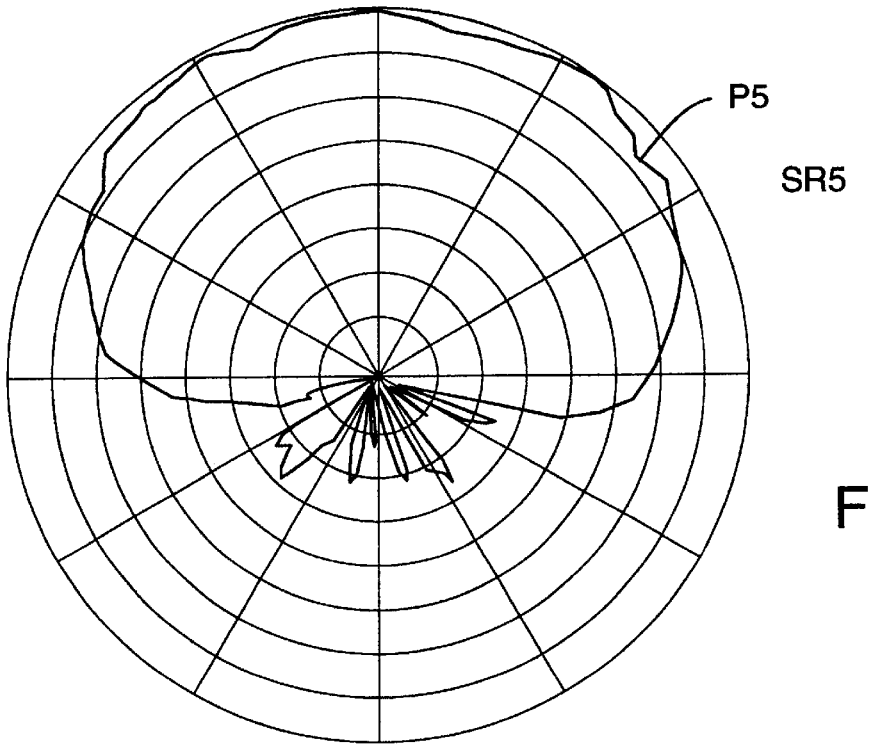
FIG. 14 is an elevation radiation pattern for the satellite antenna when the terrestrial antenna is not present.
Figure 15:
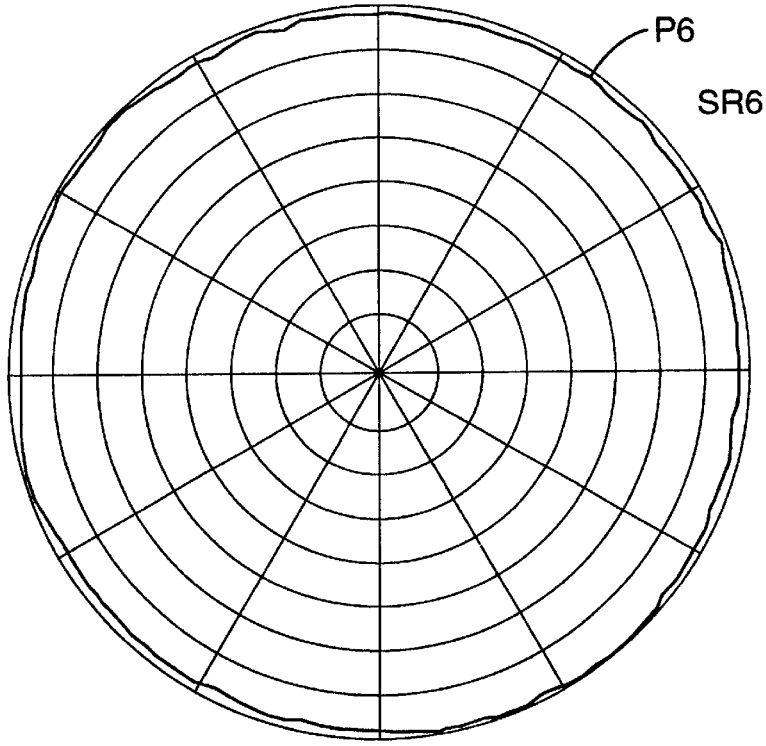
FIG. 15 is an azimuth radiation pattern for the satellite antenna when the terrestrial antenna is not present.

FIG. 14 is an elevation radiation pattern for the cross dipole antenna 110 without the monopoles 120, and FIG. 15 illustrates the azimuth radiation pattern of the same antenna. Such an antenna is not illustrated in the drawings. FIGS. 14 and 15 are provided to illustrate the lesser performance (defined as inadequate pattern coverage) of the satellite antenna 110 when not "complimented" by the monopole antenna 120.

Figure 16:
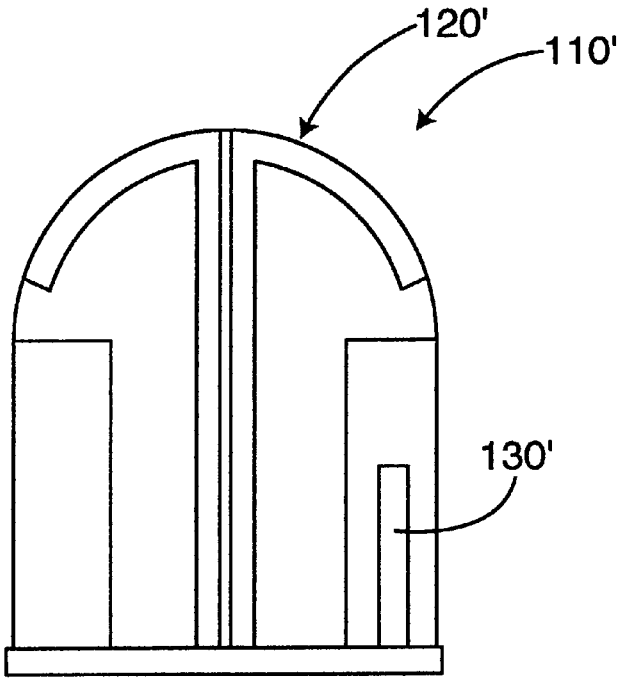
FIG. 16 is a side schematic view of an alternative antenna system having only one monopole for a terrestrial antenna.
Figure 17:
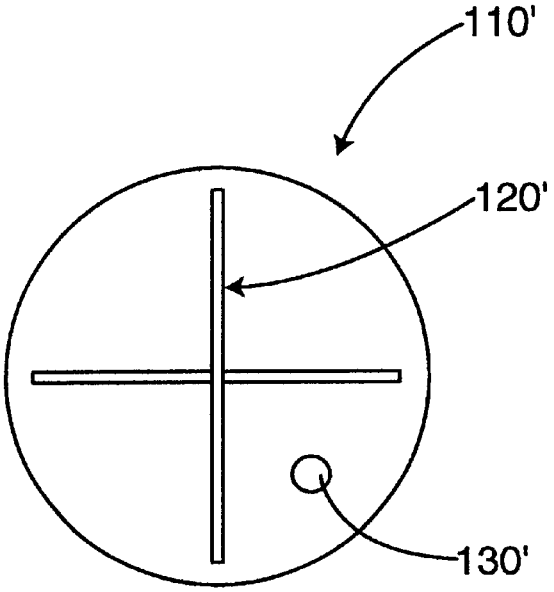
FIG. 17 is a top schematic view of the antenna system illustrated in FIG. 16.

FIGS. 16–17 illustrate an antenna that is not part of the present invention, and FIGS. 18–21 show the radiation patterns for such an antenna. These figures are included to illustrate the symmetric design of the present invention. The antenna system 100' includes a satellite antenna 110' which is identical to the satellite antenna of the preferred embodiment. The assembly 110' also includes a single monopole terrestrial antenna 120' positioned within one quadrant of the cross dipole antenna. Consequently, the terrestrial antenna 110' is neither concentric with nor symmetrically spaced about the cross dipole antenna 120'.

Figure 18:
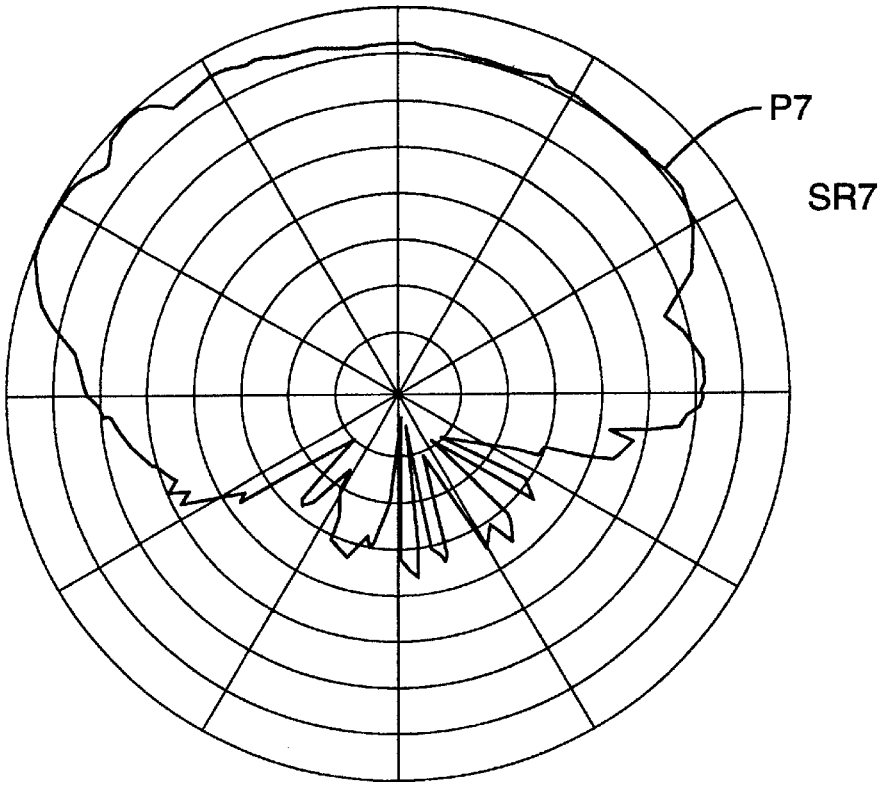
FIG. 18 is an elevation radiation pattern for the satellite antenna of the system illustrated in FIGS. 16 and 17.
Figure 19:
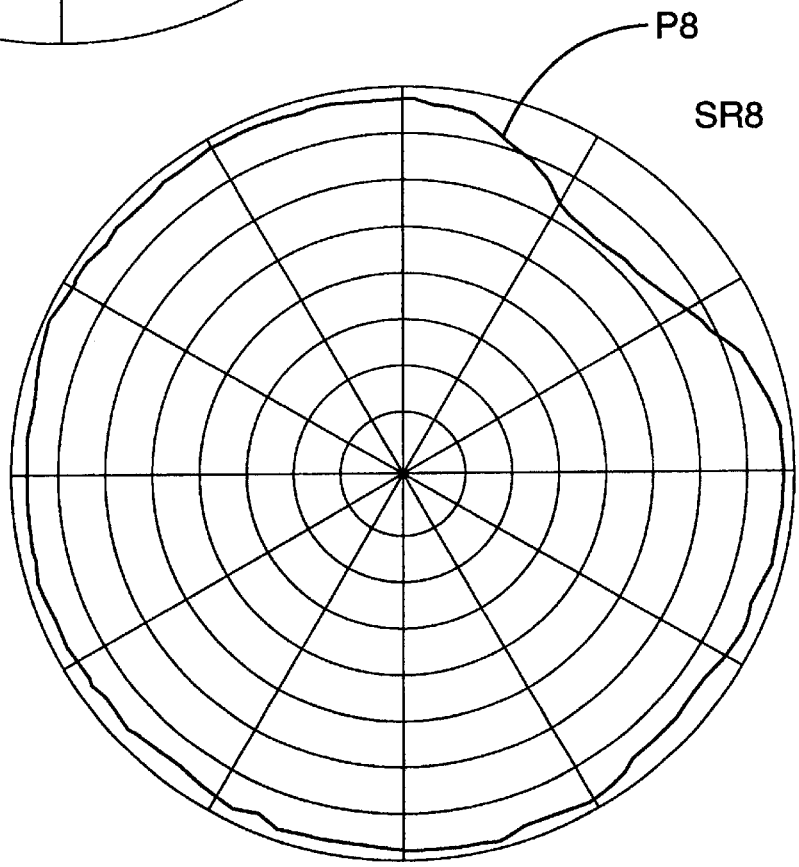
FIG. 19 is an azimuth radiation pattern for the satellite antenna of the antennas system illustrated in FIGS. 16–17.

FIG. 18 illustrates the elevation radiation pattern of the satellite antenna 110' in the assembly 100'. Similarly, FIG. 19 illustrates the azimuth radiation pattern of the satellite antenna. As can be seen, both radiation patterns P7 (FIG. 18) and P8 (FIG. 19) evidence decreased performance of the antenna system 100' in comparison to the assembly 100 (see FIGS. 10–11).

Figure 20:
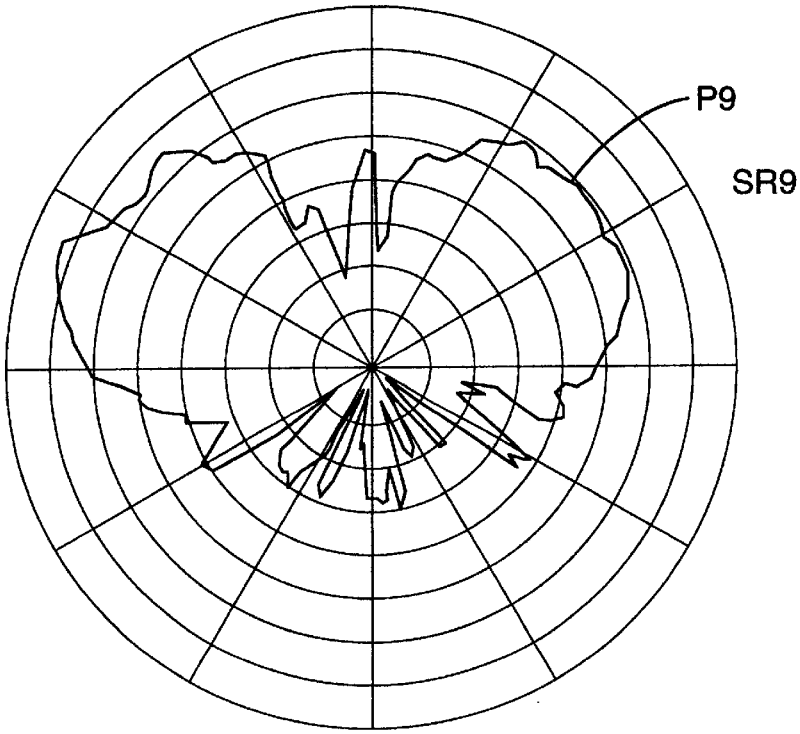
FIG. 20 is an elevation radiation pattern for the terrestrial antenna of the antenna system illustrated in FIGS. 16–17.
Figure 21:
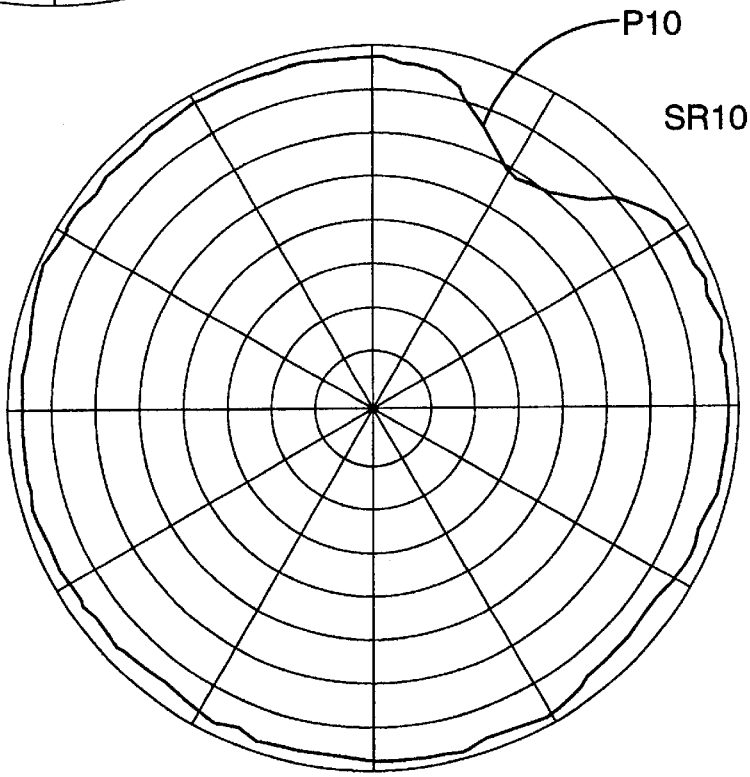
FIG. 21 is an azimuth radiation pattern for the terrestrial antenna of the antenna system illustrated in FIGS. 16–17.

FIG. 20 illustrates the elevation radiation pattern of the single monopole 120'. FIG. 21 illustrates the azimuth radiation pattern of the same antenna. Again, both of the radiation patterns P9 and P10 show decreased performance in comparison to their counterparts P3 and P4 (FIGS. 12–13) for the antenna system 100. Consequently, the inclusion of a plurality of monopoles in the terrestrial antenna symmetrically positioned with respect to the satellite antenna enhances the performance both of the satellite antenna and the terrestrial antenna. The symmetrical and/or concentric positioning of the two antennas with respect to one another is the reason behind the improved performance.

III. First Alternative Embodiment

Figure 22:
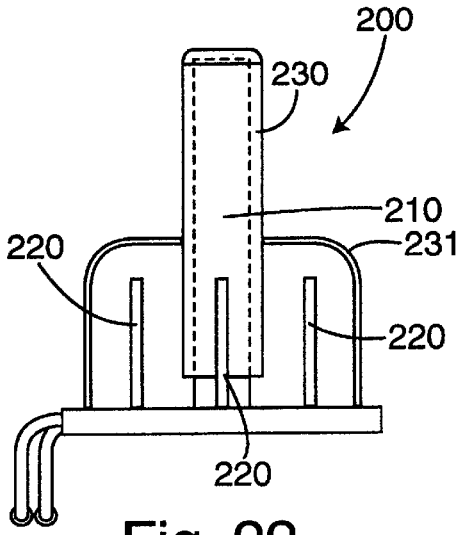
FIG. 22 is a side view of a first alternative embodiment of the antenna system.
Figure 23:
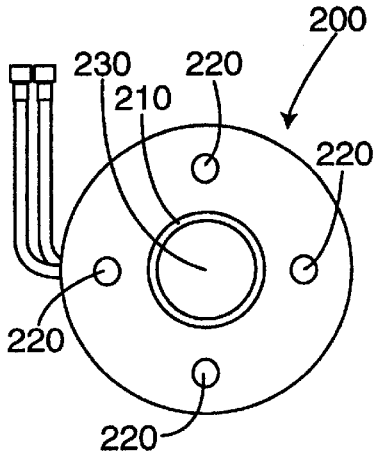
FIG. 23 is a top plan view of the first alternative embodiment.
Figure 24:
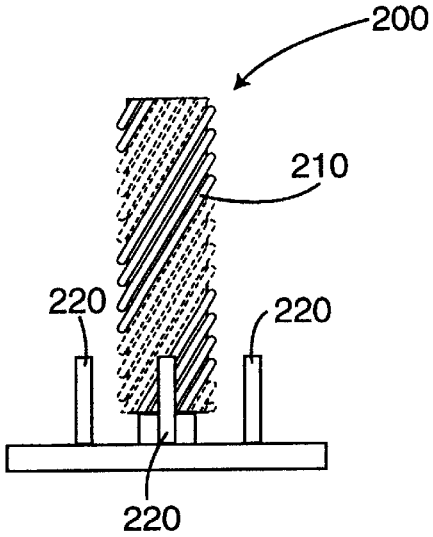
FIG. 24 is a side schematic view of the antenna elements of the first alternative embodiment.
Figure 25:
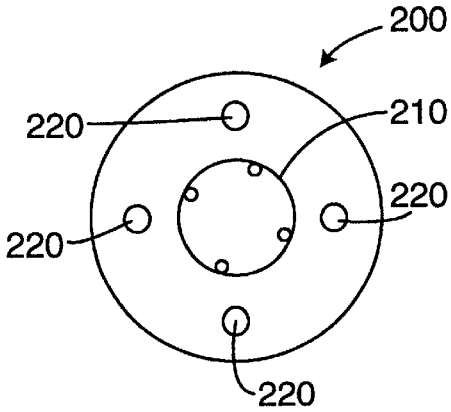
FIG. 25 is a top schematic view of the antenna elements of the first alternative embodiment.
Figure 26:
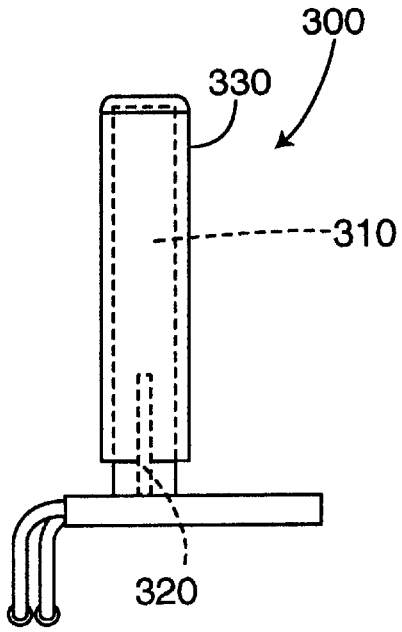
FIG. 26 is a side view of a second alternative embodiment of the antenna system.
Figure 27:
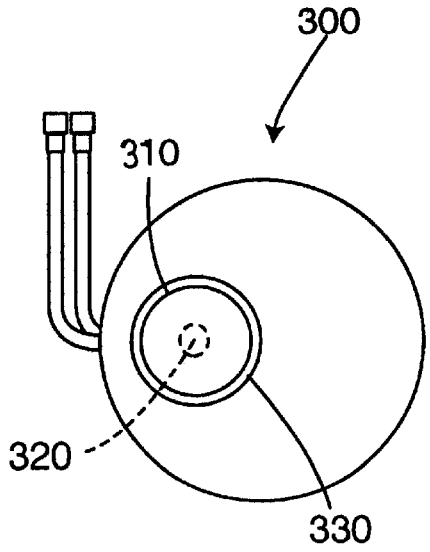
FIG. 27 is a top plan view of the second alternative embodiment.
Figure 28:
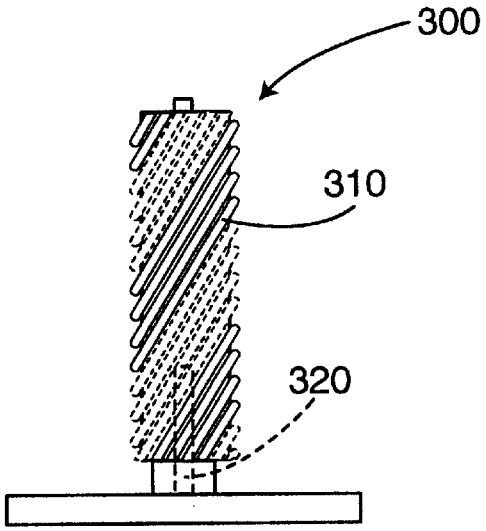
FIG. 28 is a side schematic view of the antenna elements of the second alternative embodiment.
Figure 29:
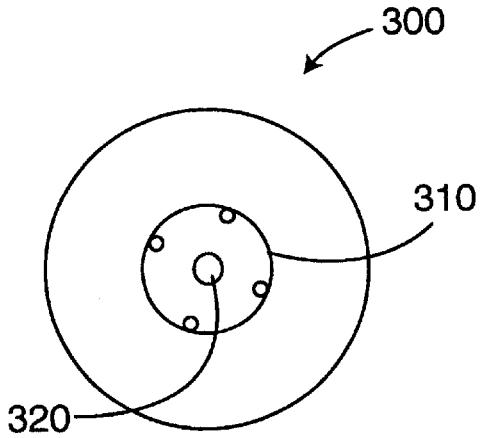
FIG. 29 is a top schematic view of the antenna elements of the second alternative embodiment.
Figure 30:
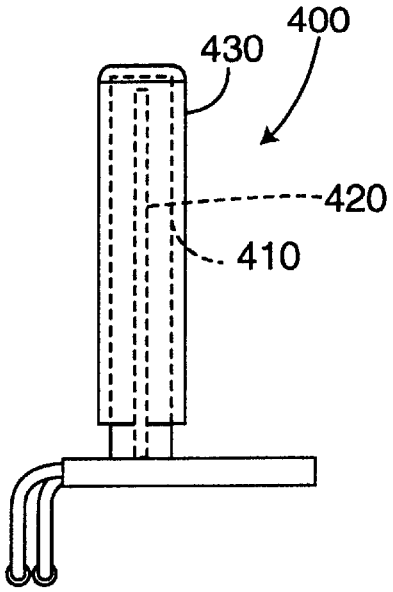
FIG. 30 is a side view of a third alternative embodiment of the antenna system.
Figure 31:
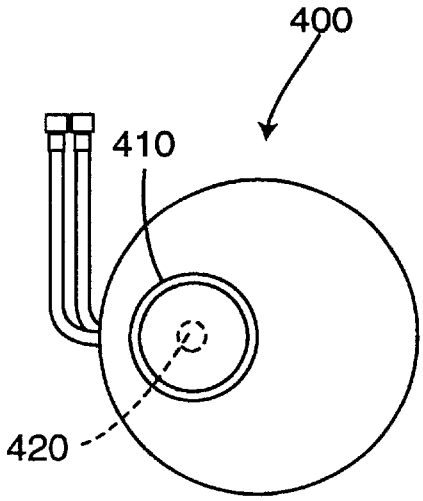
FIG. 31 is a top plan view of the third alternative embodiment.
Figure 32:
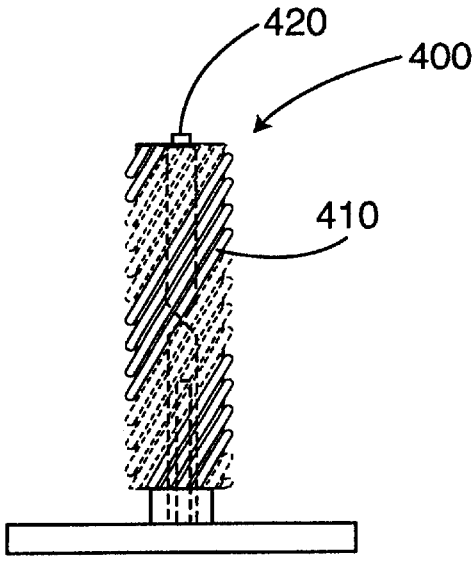
FIG. 32 is a side schematic view of the antenna elements of the third alternative embodiment.
Figure 33:
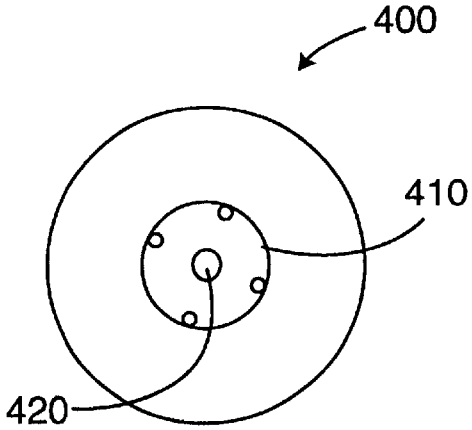
FIG. 33 is a top schematic view of the antenna elements of the third alternative embodiment.

An alternative embodiment 200 of the present invention is illustrated in FIGS. 22–25. Schematically as illustrated in FIGS. 24–25, the assembly 200 includes a quadrifilar (quad) helix antenna 210 and a terrestrial antenna including four monopoles 220. As perhaps best illustrated in FIGS. 23 and 25, the monopoles are positioned around the satellite antenna 210 in a symmetrical pattern. In fact, the monopoles collectively are concentric with the satellite antenna 210. As is well known to those skilled in the art, the quad helix antenna 210 is adapted to receive signals from a satellite transmitter. The monopoles 220 function as described in conjunction with the antenna system 100. As illustrated in FIG. 22, the antenna system 200 includes a first dome 230 protectively encasing the antenna 210 and a second dome 231 protectively encasing the monopoles 220.

The performance of the antenna system 200 is generally similar to that of the performance of the antenna system 100. Accordingly, the radiation patterns associated with the assembly 200 will be extremely similar to the radiation patterns illustrated in FIGS. 10–13.

IV. Second Alternative Embodiment

A second alternative embodiment 300 of the antenna system is illustrated in FIGS. 26–29. For the satellite antenna, the assembly 300 includes a quad helix 310 generally identical to the quad helix 210 previously described. For the terrestrial antenna, the assembly 300 includes a single monopole 320 which is positioned concentrically within the quad helix 310. A protective dome 330 is positioned over the antenna elements.

Again, the performance of the antenna system 300 is generally identical to that of the system 100 as illustrated in FIGS. 10–13, because of the concentric and/or symmetric relationship of the satellite antenna 310 and the terrestrial antenna 320.

V. Third Alternative Embodiment

A third alternative embodiment 400 is illustrated in FIGS. 30–33. Assembly 400 is generally identical to assembly 300 with the exception that the terrestrial antenna 320 is a sleeve dipole antenna known in the art. The sleeve dipole 420 is positioned inside and concentric with the quad helix antenna 410. Consequently, the two antennas are also symmetrical with respect to one another.

Figure 34:
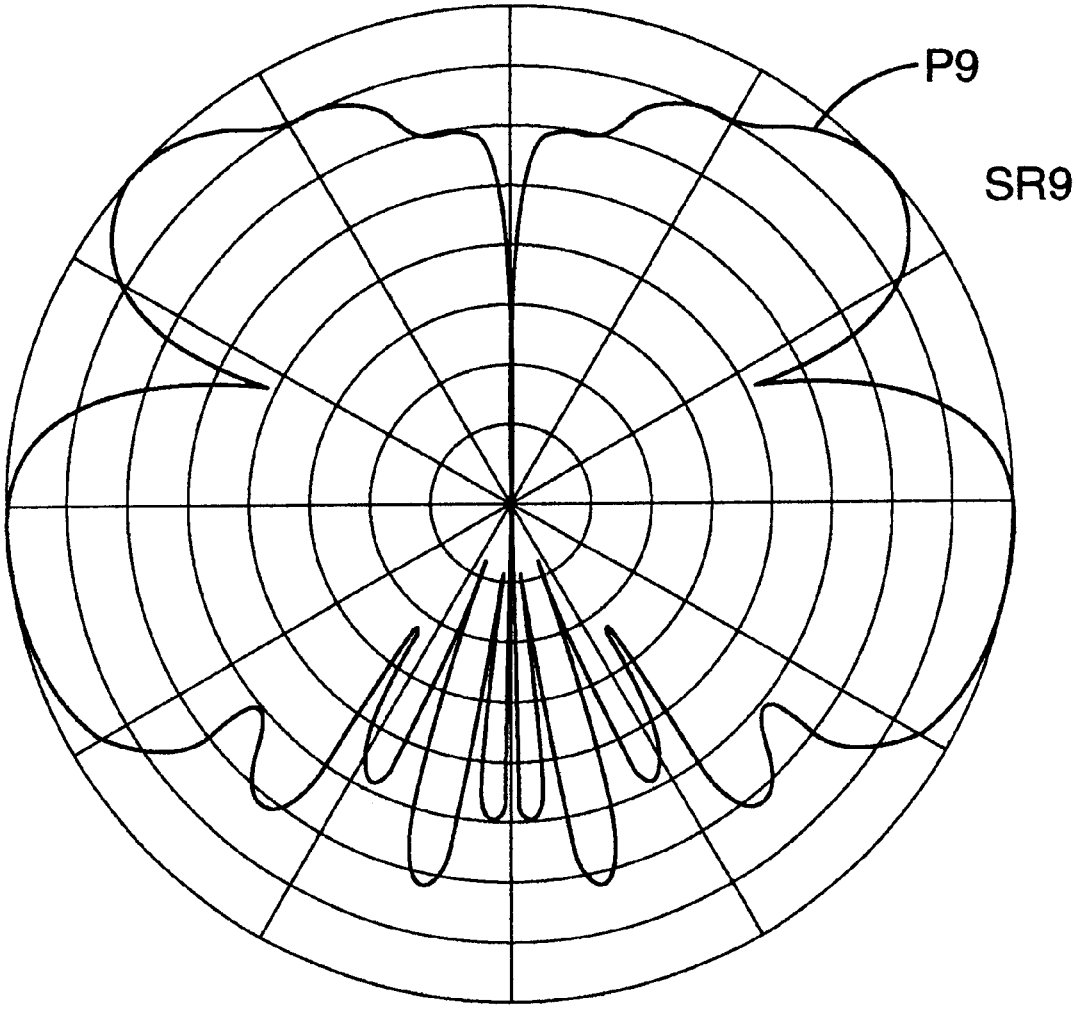
FIG. 34 is an elevation radiation pattern for the terrestrial antenna of the third alternative embodiment illustrated in FIGS. 30–33.

FIG. 34 illustrates the elevation radiation pattern of the sleeve dipole antenna 420. The radiation pattern illustrates the improved horizon coverage of the sleeve dipole. With the exception of the differences in the radiation pattern illustrated in FIG. 34, the performance of the antenna system 400 is generally the same as the previously described antennas.

Figure 35:
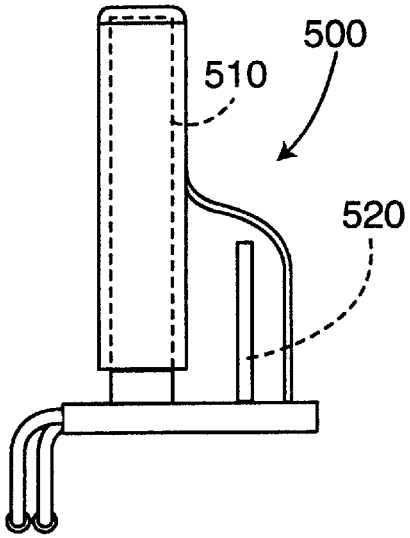
FIG. 35 is a side view of a fourth alternative embodiment of the antenna system.
Figure 36:
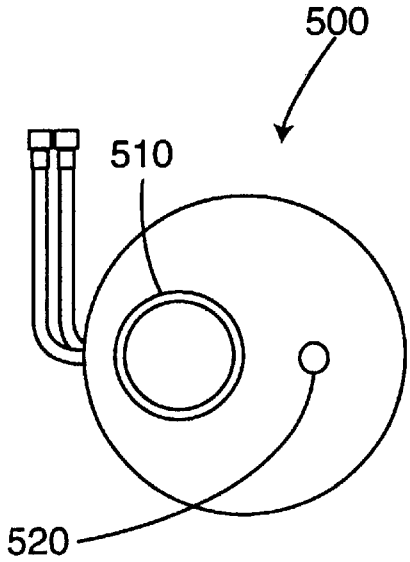
FIG. 36 is a top plan view of the fourth alternative embodiment.
Figure 37:
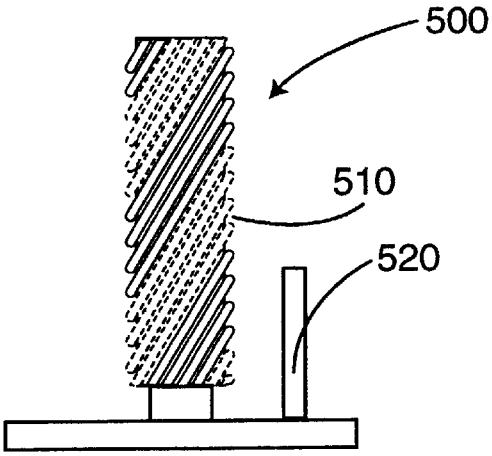
FIG. 37 is a side schematic view of the antenna elements of the fourth alternative embodiment.
Figure 38:
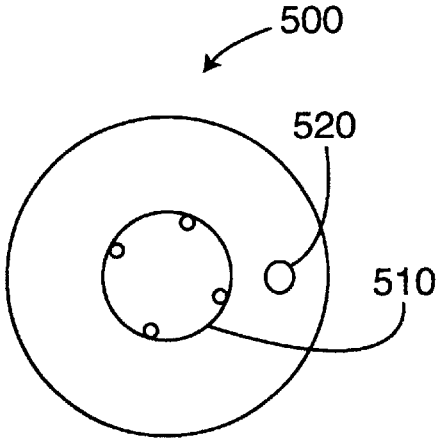
FIG. 38 is a top schematic view of the antenna elements of the fourth alternative embodiment.

FIG. 35 illustrates an antenna system 500 that is not within the scope of the present invention. Specifically, the terrestrial monopole 520 is neither concentric with nor symmetric to the quad helix satellite antenna 510. Accordingly, the performance of the antenna system 500 would be substantially similar to the performance illustrated in FIGS. 18–21.

All embodiments of the present invention provide the unanticipated benefit of high isolation between the satellite antenna and the terrestrial antenna. When the antennas are fed in-phase, the isolation is greater than 30 decibels (dB).

The above descriptions are those of preferred embodiments of the invention. Various alterations and changes can be made without departing from the spirit and broader aspects of the invention as defined in the appended claims, which are to be interpreted in accordance with the principles of patent law including the Doctrine of Equivalents.

The embodiments of the invention in which an exclusive property or privilege is claimed are defined as follows:

1. A dual-antenna system comprising:

a circularly polarized antenna for receiving circularly polarized signals from a satellite transmitter, said circularly polarized antenna having a first output; and a linear antenna for receiving linear signals from a terrestrial transmitter, said linear antenna having a second output different from said first output, said circularly polarized antenna and said linear antenna being substantially concentric, said linear antenna including a plurality of linear antenna elements arranged symmetrically about said circularly polarized antenna.

2. A dual-antenna system as defined in claim 1 wherein said circularly polarized antenna is a helix antenna.

3. A dual-antenna system as defined in claim 2 wherein each of said linear antenna elements is a monopole antenna.

4. A dual-antenna system as defined in claim 1 wherein said circularly polarized antenna comprises a cross dipole.

5. A dual-antenna system comprising:

a first antenna for receiving and outputting circularly polarized signals, said first antenna having a center and a first output; and a second antenna for receiving and outputting linearly polarized signals, said second antenna having a center and a second output separate from the first output, said first antenna and said second antenna being substantially concentric, said second antenna including a plurality of linear antenna elements arranged in a substantially symmetric configuration about said first antenna.

6. A dual-antenna system as defined in claim 5 wherein said first antenna comprises a cross dipole.

7. A dual-antenna system as defined in claim 5 wherein said first antenna comprises a helix antenna.

8. A dual-antenna system as defined in claim 5 wherein each of said linear antenna elements comprises a monopole antenna.

9. A dual-antenna system comprising:

a cross dipole antenna having a cross dipole output; and a plurality of linear antenna elements arranged in a substantially symmetric pattern about said cross dipole antenna, said linear antenna elements having a linear output.

10. A dual-antenna system comprising:

a cross dipole antenna; and four monopole antennas arranged in a substantially symmetric pattern about said cross dipole antenna with one of said monopole antennas located in each of the quadrants of said cross dipole antenna.

11. A dual-antenna system as defined in claim 10 wherein said monopole antennas are equally spaced from one another.

12. A dual-antenna system comprising:

a helix antenna having a first output; and a plurality of linear antennas arranged symmetrically with respect to said helix, said linear antennas having a second output different from said first output antenna.

13. A dual-antenna system as defined in claim 12 wherein each of said linear antennas is a monopole antenna.

14. A dual-antenna system comprising:

a helix antenna having a first output; and a plurality of monopole antennas arranged symmetrically with respect to said, said monopole antennas having a second output different from said first output helix antenna.

15. A dual-antenna system as defined in claim 14 comprising four of said monopole antennas.

* * * * *

UNITED STATES PATENT AND TRADEMARK OFFICE

CERTIFICATE OF CORRECTION

PATENT NO. : 6,329,954 B1
DATED : December 11, 2001
INVENTOR(S) : Fuchs et al.

It is certified that error appears in the above-identified patent and that said Letters Patent is hereby corrected as shown below:

Column 8,
Line 31, after "helix" insert -- antenna --
Line 32, after "output" delete -- antenna --
Line 38, after first "said" insert -- helix antenna --
Line 39, after "output" delete -- helix antenna --

Signed and Sealed this

Thirtieth Day of April, 2002

*Attest:*

*Attesting Officer*

JAMES E. ROGAN
*Director of the United States Patent and Trademark Office*